US007827792B2

(12) United States Patent
Brown, Jr.

(10) Patent No.: US 7,827,792 B2
(45) Date of Patent: Nov. 9, 2010

(54) REFRIGERANT COOLED MAIN STEAM CONDENSER BINARY CYCLE

(76) Inventor: Joseph Francis Brown, Jr., 11 Rose La., Cherry Hill, NJ (US) 08002

( * ) Notice: Subject to any disclaimer, the term of this patent is extended or adjusted under 35 U.S.C. 154(b) by 839 days.

(21) Appl. No.: 11/444,615

(22) Filed: Jun. 1, 2006

(65) Prior Publication Data

US 2007/0137205 A1 Jun. 21, 2007

(51) Int. Cl.
*F01K 7/34* (2006.01)

(52) U.S. Cl. ..... 60/653; 60/654; 60/655

(58) Field of Classification Search ..... 60/644.1, 60/670, 685, 653, 654, 655
See application file for complete search history.

(56) References Cited

U.S. PATENT DOCUMENTS 2,496,041 A * 1/1950 Dickey ..... 60/668
2,982,864 A * 5/1961 Furreboe ..... 290/2
3,943,719 A * 3/1976 Terry et al. ..... 376/324
4,291,536 A * 9/1981 Girard ..... 60/644.1

* cited by examiner

*Primary Examiner*—Hoang M Nguyen

(57) ABSTRACT

This invention reduces the fuel consumption of the modern day power plant by lowering the main steam condenser operating pressure. The main steam condenser is a heat exchanger located in the power plant steam system for condensing steam. The main steam enters the main steam condenser, flowing around the tubes with the coolant flowing thru the tubes, condensing the steam. This invention replaces the present condenser once thru cooling water system with a refrigerant cooling system. The much lower normal temperature and greater high heat absorption rate of the refrigerant, lowers the main steam condenser operating pressure much below that of the present cooling water system. The lower condenser pressure increases steam flow, extracting more energy from the steam, increasing the plant-operating efficiency. This invention combines the conventional steam cycle with the conventional refrigeration cycle. The refrigerant compressor is driven by the main steam turbine which creates the binary cycle.

1 Claim, 3 Drawing Sheets

REFRIGERANT COOLED MAIN STEAM CONDENSER SCHEMATIC DIAGRAM

REFRIGERANT COOLED MAIN STEAM CONDENSER BINARY CYCLE SCHEMATIC DIAGRAM

REFRIGERANT COOLED MAIN STEAM CONDENSER SCHEMATIC DIAGRAM

REFRIGERANT COOLED MAIN STEAM CONDENSER PHYSICAL SCHEMATIC ARRANGEMENT

REFRIGERANT COOLED MAIN STEAM CONDENSER BINARY CYCLE

The major intent of this invention is to improve the operational efficiency and the functional design of the modern day electrical power generating station. This invention replaces the main steam condenser once through cooling water system with a refrigerant cooling system. The invention is directed primarily toward new power plant construction. Maintenance, equipment replacement cost and future operating cost savings may make it beneficial to convert existing stations. The main steam condenser refrigerant cooling system will reduce fuel consumption with compatible power generation to that of the cooling water system. The intent of this invention is not to redesign the conventional steam cycle or the conventional refrigeration cycle but to combine them. The following drawings will aid in the clarification of this invention:

Figure 1:
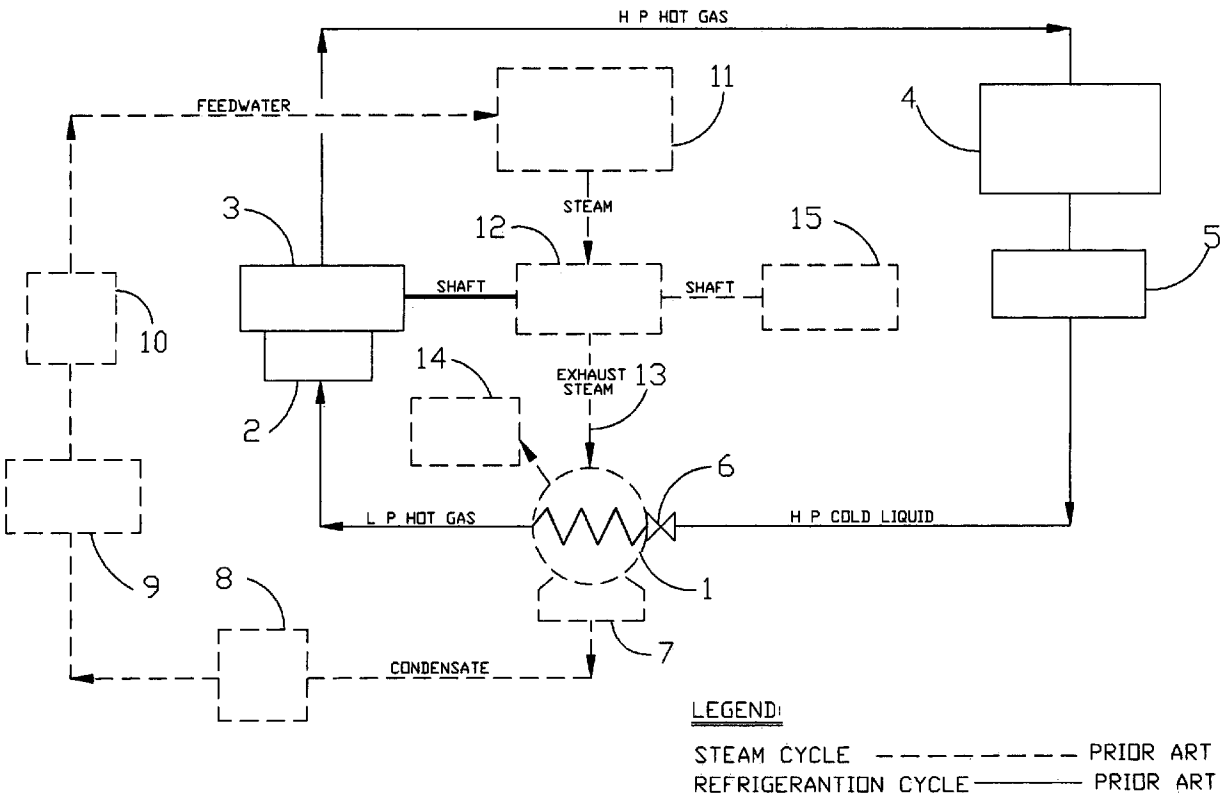
FIG. 1 is a schematic diagram which shows the conventional steam cycle and the conventional refrigerant cycle crossing at the main steam condenser, where the heat exchange takes place.

The combined cycles become known as a binary cycle. (FIG. 1) The present day main steam condenser requires very large quantities of cooling water. Circulating pumps supply the main steam condenser with cooling water from nearby rivers or lakes to condense the main steam. The main condenser cooling water flows thru a water intake structure, designed to prevent sea-life from entering the cooling water system. The elaborate intake structure is in compliance with environmental requirements. When the heated water from the main steam condenser is returned to the river or lake, it is directed far from the shoreline. This insures proper mixing and does not allow elevated river or lake temperatures. Many modern day power plants have installed natural draft cooling towers to eliminate the concern for elevated river or lake temperatures. The natural draft towers have a vapor plume which may cause an environmental hazard. The new main steam condenser refrigerant cooling system has many advantages over the present day once thru water-cooling system. It should be noted with a refrigerant cooling system, the intake structure and need for cooling towers is longer required. More importantly, the power plant location is no longer dependent upon large bodies of water, which presently governs power plant location. The present once thru cooling water system is very corrosive due to electrolysis and poor water quality.

Figure 2:
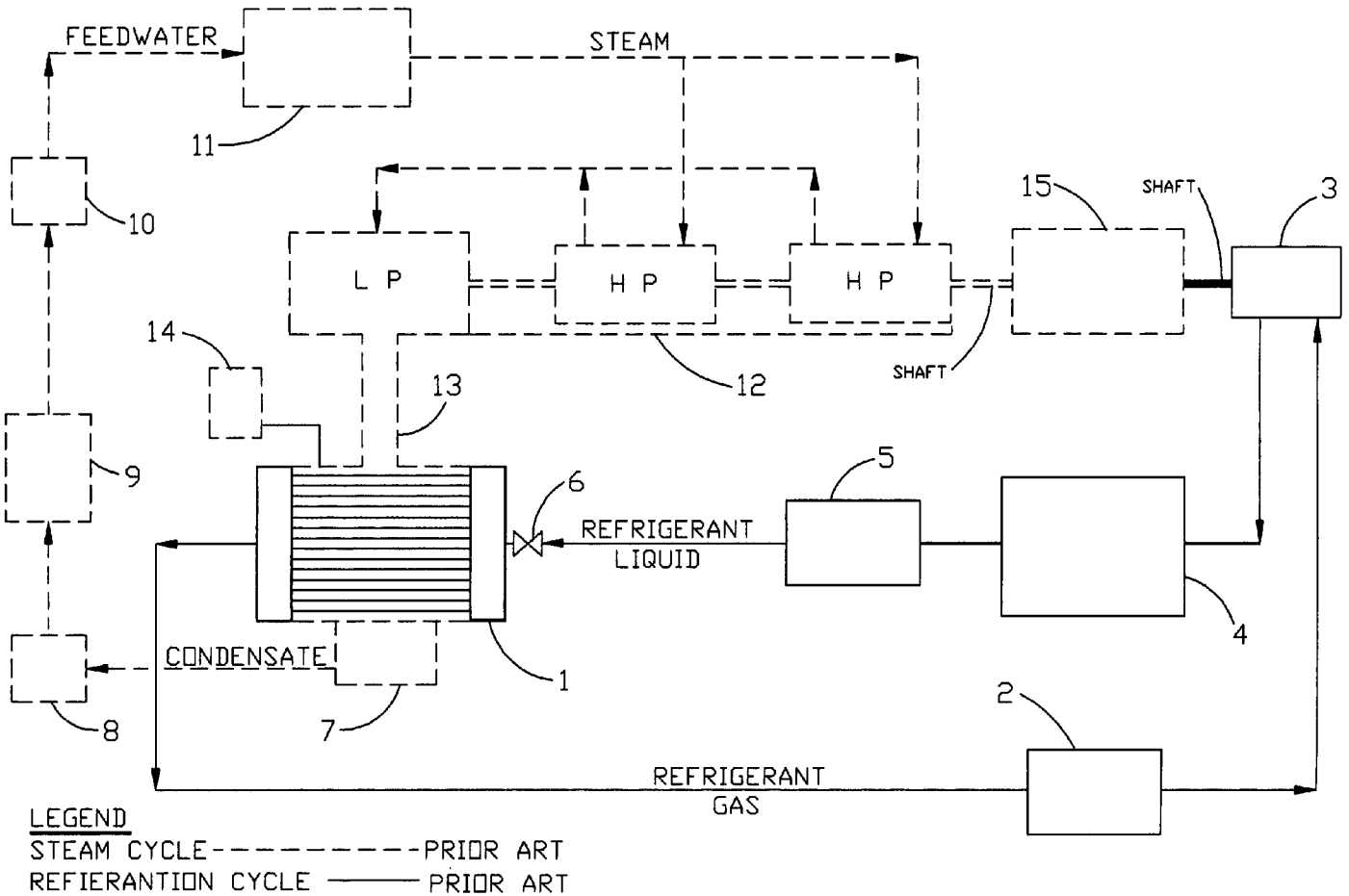
FIG. 2 is a schematic diagram showing the equipment and flow arrangement of the conventional steam cycle and conventional refrigerant cycle.
Figure 3:
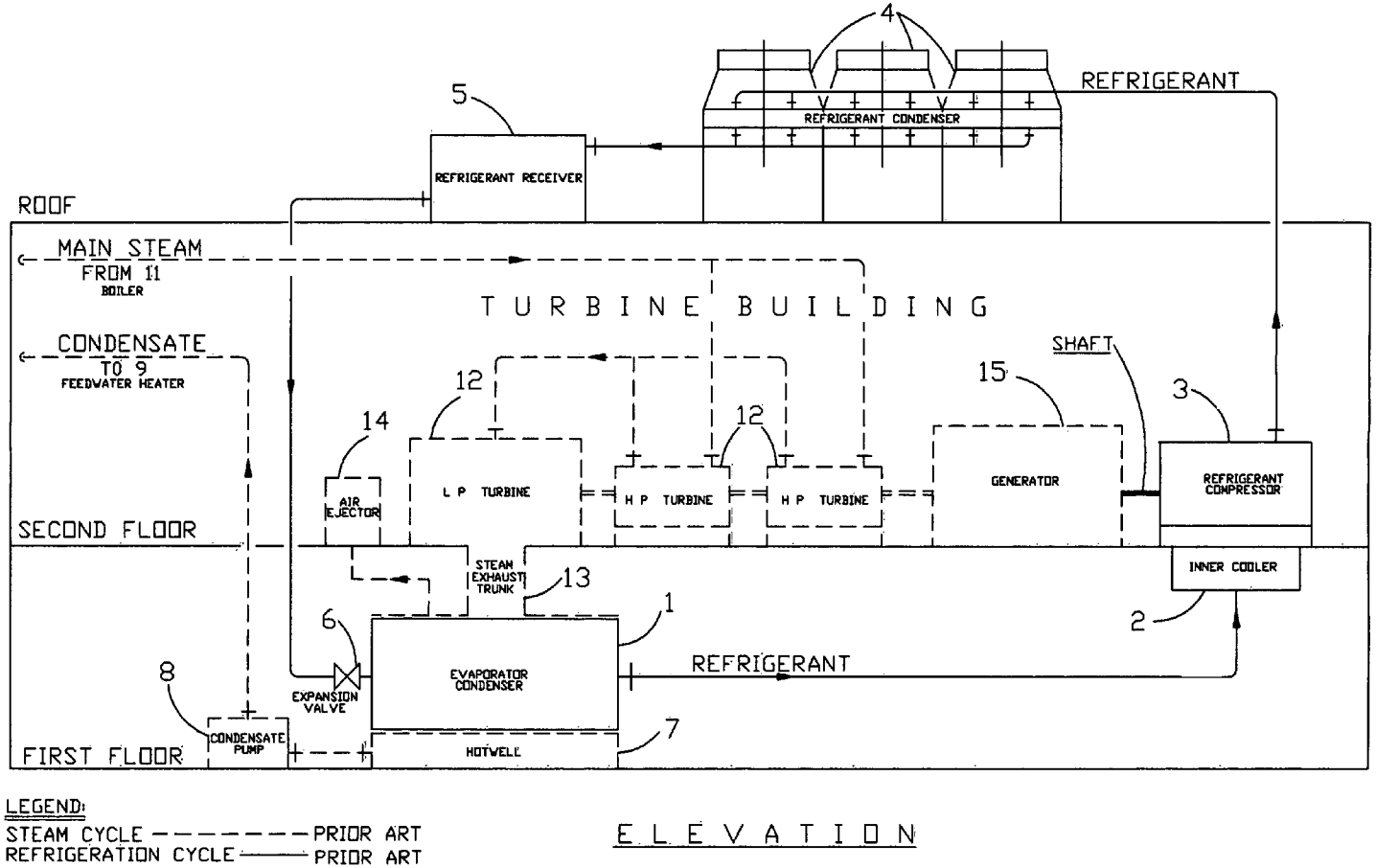
FIG. 3 is a physical schematic building cross-section diagram showing a probable arrangement of equipment and flow pattern for the steam and refrigerant combined cycle.

The refrigerant coolant is non-corrosive reducing plant maintenance costs. The heat from the present once thru cooling water system is transfer to the river or lake. The main steam condenser refrigerant cooling system allows for transfer of heat energy to building services, boiler feed and other utilities requiring heated water. The heat energy is not wasted. The main steam condenser refrigerant cooling system has greater temperature control than the present day once thru cooling water system. The refrigerant flow to the main steam condenser can be set at a constant, desired temperature. The conventional once thru cooling water temperature is constant and capacity is subject to pump design. The uniqueness of this invention is driving the refrigerant compressor with the main steam turbine. The main steam condenser and refrigerant evaporator share the same container and become one, and can now be known as the evaporator condenser. This combination also adds to the making of a binary cycle. The steam cycle and the refrigeration cycle remain unchanged with this invention. The installation of the combined conventional systems is as follows. (FIGS. 2 & 3) The refrigerant compressor 3 is located in the main turbine building and is directly connected to the main generator shaft. The main steam turbine drives the generator 15 and the compressor. 3 The refrigerant gas is compressed and transferred to the refrigerant condenser, 4 located on the main turbine building roof. The heat gained by absorption from the condensing steam and the heat of compression caused by the refrigerant compressor 3 is removed by the refrigerant condenser. 4 The air-cooled heat exchangers 4 remove heat and condense the refrigerant gas. The condensed liquid refrigerant is transferred to the refrigerant receiver, 5 located on the main turbine-building roof and is the high-pressure refrigerant storage tank. 5 The condensed liquid refrigerant is transferred to the refrigerant expansion valve, 6 The refrigerant expansion Valve 6 is located at the coolant entrance to the main steam evaporator condenser. 1 Its function is to allow the refrigerant to change from a high-pressure liquid to a low-pressure liquid, lowering the boiling point of the refrigerant. The low-pressure liquid refrigerant flows thru the condenser tubes, absorbing heat, changing into a gas, in turn condensing the steam. The evaporator condenser 1 is located under the Main Steam low pressure Turbine 12 and is connected by a steam exhaust trunk 13. The refrigerant intercooler 2 is located between the evaporator condenser 1 and the refrigerant compressor 3. The inter-cooler removes excess heat from the refrigerant gas, prior to entering the compressor. The refrigerant condenser will remove the inter-cooler heat. The main steam boiler 11 heats the feed water changing it into steam. Main steam under pressure is transferred to the main steam turbine, through a piping system. The main steam enters the main steam turbine and is directed onto the turbine blades causing the turbines to rotate. The rotating turbine shaft is connected to the generator which produces electrical power. The condenser air ejectors 14 remove air from the evaporator condenser to lower the internal pressure. The air ejector 14 design is in accordance with system start-up capacity.

The main steam exhaust trunk 13 is located at the base of the main steam turbines and directs the exhaust steam into the evaporator condenser 1. The steam enters the evaporator condenser 1 flowing around the tubes. The coolant flowing through the tubes changes the steam into condensate which collects in the condenser evaporator hotwell. 7 The condenser hotwell 7 is located in the lower portion of the evaporator condenser 1 and is the storage area for the condensate pump. The main condensate pump 8 takes suction from the hotwell 7 and delivers the condensate to the boiler feedwater heater 9 The feedwater heater 9 is the storage area for the feedwater pump 10. The main feedwater pump 10 delivers water to the main steam boiler 11 to produce main steam. The cycle is continuously repeated.

DETAILED DESCRIPTION OF INVENTION

This invention replaces the main steam condenser cooling water system with a refrigerant cooling system. It should be noted that there is no intent of redesigning the steam cycle or refrigeration cycle. The combining of the steam condenser and the refrigerant evaporator along with the refrigerant compressor being driven by the main steam turbine creates the binary cycle. (FIGS. 1 & 2) The main steam condenser in the modern day power plant is sometimes called the heart of the steam cycle. The differential pressure between the boiler and the condenser causes steam to flow. The lower the internal condenser pressure the more steam flow. The refrigerant low normal temperature and high heat transfer rate lowers the main steam condenser internal pressure much below that of the once thru cooling water system. This increased reduction in the condenser pressure makes the steam cycle much more efficient. This invention is directed toward new plant construction but a maintenance economic evaluation may constitute a conversion to an existing plant. The main steam condenser air ejectors remove air from the condenser vessel also lowering the internal pressure. The air ejector system design capacity is essential for system start-up. The conventional refrigerant cycle is very efficient and very reliable. The simplicity of the refrigerant cooling system will also provide reusable heat for building services and the main steam feed water. The refrigerant cooling system is much more efficient than the water-cooled system, less fuel consumption for the same power generated.

BRIEF SUMMARY OF THE INVENTION

This invention has to do with the cooling system for the main steam condenser in the modern-day power plant. This invention replaces the main steam condenser existing once thru cooling water system with a refrigerant cooling system. In order for the steam cycle to function properly the main steam produced by the boiler must have a low-pressure area to discharge into. This area is the main steam condenser. The lower the pressure area the more efficient the system. When the energy of the steam is spent, after rotating the turbines, it discharges into the main steam condenser. The steam flows around the condenser tubes, as the coolant flows through the tubes the temperature difference causes the steam to condense. The lower the temperature of the coolant flowing thru the tubes the faster the steam is condensed. The condensing of the increased steam flow lowers the main steam condenser internal pressure. The refrigerant cooling system, improves the efficiency of the system, over the main steam condenser water-cooled system, considerably. The refrigerant has a normal temperature much lower than that of water and a much higher heat transfer rate than water. The main steam condenser refrigerant cooling system is controlled whereas the water-cooled condenser system fluctuates, because of seasonal temperature changes of the river or lake water. For example, the modern day power generating station produces less power in the summer months. The main steam condenser refrigerant cooling system will be much more fuel efficient than, the present once thru cooling water system.

BACKGROUND OF THE INVENTION

This invention was inspired by the rising energy costs and public concerns. Utilities pass-on much of the increased energy costs to the public. To improve the efficiency of the power source, is to, lower consumer costs. The refrigerant cooling system replacement of the present once thru cooling system will reduce these costs. The lower utility costs and the elimination of the cooling towers and hot water returns to the river or lake, will reduce public economic and environmental concerns.

The invention claimed is:

1. A refrigerant cooled main steam condenser binary system with increased power output and reduced fuel consumption comprising a steam cycle and a refrigerant cycle, a main steam evaporator condenser (1) for condensing the exhaust steam from a steam turbine (12) and evaporating the refrigerant liquid of said refrigerant cycle, an inner cooler (2) for removing excess heat of the exhaust refrigerant gas from said main steam evaporator condenser (1) before said refrigerant gas entering a refrigerant compressor (3), a refrigerant condenser (4) for condensing the hot refrigerant gas from said compressor to form refrigerant liquid before sending said refrigerant liquid to a refrigerant receiver (5), an expansion valve (6) for controlling the input of said refrigerant liquid into said main steam evaporator condenser (1), a hotwell under said evaporator condenser (1) for collecting water formed by steam condensate, a pump (8) for pumping said water through a feedwater heater (9), a feedwater pump (10) for delivering the water to a boiler (11), said boiler generating steam for said steam turbine (12), said steam turbine (12) having a common shaft to drive a generator (15) and said refrigerant compressor (3), an exhaust steam trunk (13) for delivering the exhaust steam from said steam turbine (12) to said evaporator condenser (1), an air ejector (14) removing inert gases from said evaporator condenser (1).

* * * * *